United States Patent [19]

Caporusso et al.

[11] Patent Number: 4,986,104

[45] Date of Patent: Jan. 22, 1991

[54] PORTABLE PIPE-BINDING MINIMACHINE

[76] Inventors: Alessandro Caporusso; Mario Caporusso, Via Pantanelle, 21, Piedimonte San Germano, Frosinone, Italy

[21] Appl. No.: 376,605

[22] Filed: Jul. 7, 1989

[30] Foreign Application Priority Data

Jul. 19, 1988 [IT] Italy ..... 48207 A/88

[51] Int. Cl.[5] ..... B21D 7/04

[52] U.S. Cl. ..... 72/158; 72/149

[58] Field of Search ..... 72/149, 154, 155, 156, 72/157, 158

[56] References Cited

U.S. PATENT DOCUMENTS

| | | | |
|---|---|---|---|
| 1,272,999 | 7/1918 | Rehbein | 72/157 X |
| 1,309,238 | 7/1919 | Brinkman | 72/158 X |
| 2,822,023 | 2/1958 | Ahern | 72/149 X |
| 3,236,082 | 2/1966 | Beck et al. | 72/149 |
| 3,285,048 | 11/1966 | Eskilson | 72/158 X |
| 3,785,190 | 1/1974 | Schall et al. | 72/149 |
| 4,532,787 | 8/1985 | Caporusso et al. | 72/158 |

FOREIGN PATENT DOCUMENTS

| | | | |
|---|---|---|---|
| 61-255721 | 11/1986 | Japan | 72/149 |
| 725744 | 4/1980 | U.S.S.R. | 72/149 |

*Primary Examiner*—E. Michael Combs

*Attorney, Agent, or Firm*—Young & Thompson

[57] ABSTRACT

Portable manually or motor-controlled pipe-bending minimachine which, in spite of its small size as compared with similar machines, is easier and handier to operate on site for the bending of pipes ranging 4 mm to 22 mm in diameter. The minimachine is provided with a reverse gear (53) and an intermediary device (50) built in the minimachine main body (11) which allows the engagement and automatic disengagement of the gear drive (40) transmitting rotary motion to the matrix-carrying shaft. Both the motor (90) and the manual control lever assembly (60) allowing alternate control of consecutive angular movements of matrix (16), can be easily and quickly mounted on the main body; and the countermatrix (24) is an interchangeable device to be mounted on a special support (20) allowing it to be appropriately positioned at the start of a bending operation.

3 Claims, 4 Drawing Sheets

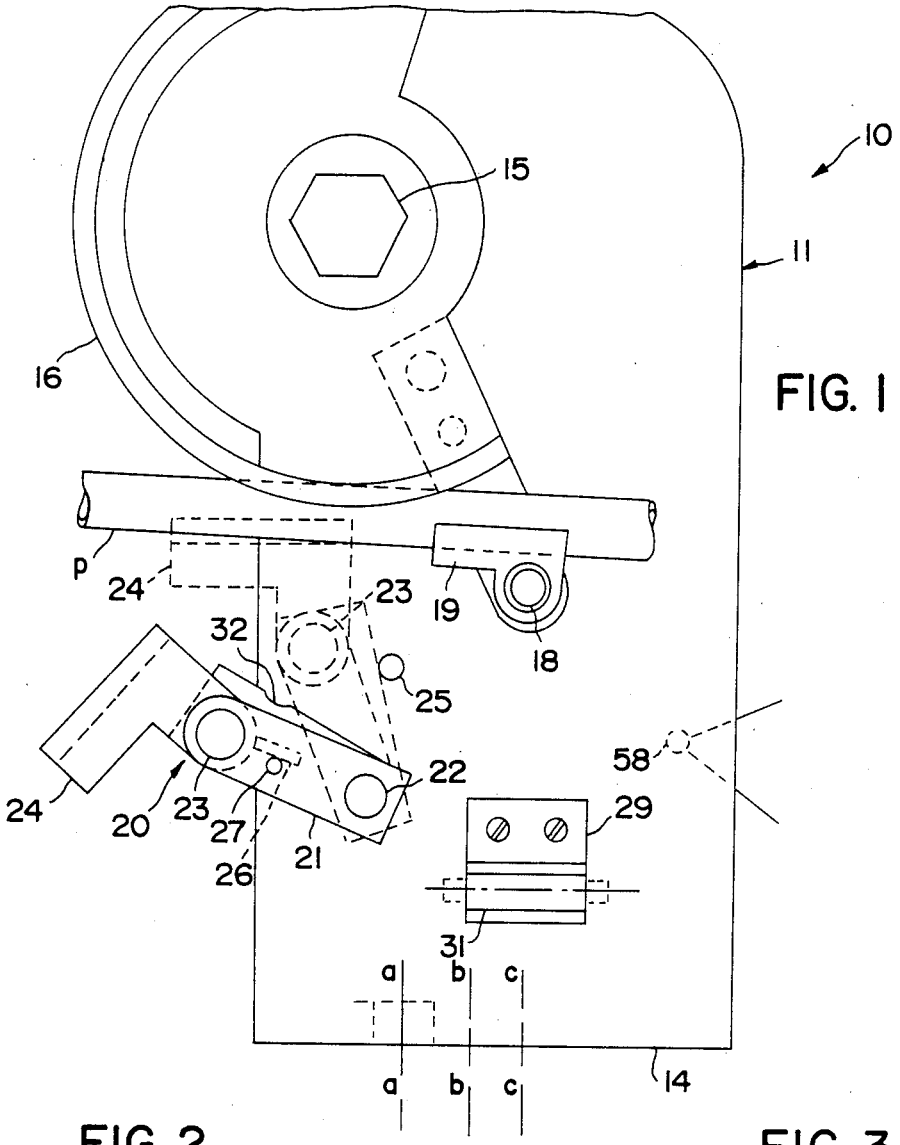
FIG. 1
FIG. 2
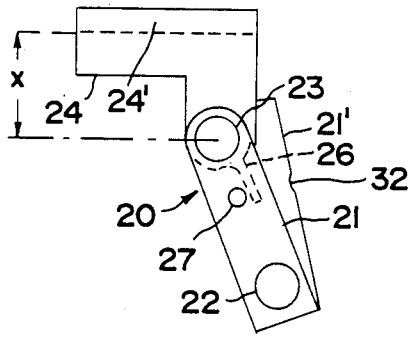
FIG. 3
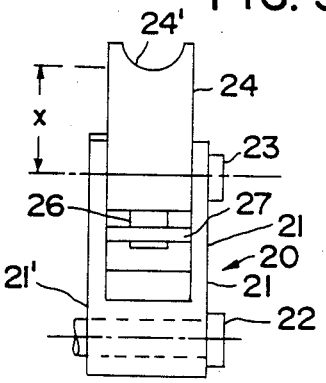

PORTABLE PIPE-BINDING MINIMACHINE

This invention relates to a portable manually- or motor-controlled pipe-bending minimachine which, in spite of its small size as compared with similar machines, is easier and handier to operate on site for the bending of pipes ranging 4 mm to 22 mm in diameter. The minimachine is provided with a reverse gear and an intermediary device built in the minimachine main body which allows the engagement and automatic disengagement of the gear drive transmitting rotary motion to the matrix-carrying shaft. Both the motor and the manual control lever assembly allowing alternate control of consecutive angular movements of the matrix, can be easily and quickly mounted on the main body; and the countermatrix is an interchangeable device to be mounted on a special support allowing it to be appropriately positioned at the start of a bending operation.

Prior art in the bending of small- and medium-diameter pipes mainly intended for use in sanitary plumbing, has proposed and constructed several types of portable pipe-bending machines or apparatuses, which are small in both size and weight so that they can be used on site, due to easier and handier operation, considering that such type of machines are widely used and also offer greater advantages lying in the lower cost of both the machines and their application, particularly in said plumbing systems.

The Applicant has previously proposed and constructed several portable pipe-bending machines designed to improve both the working conditions and the results, making use of the advanced techniques that have been developed in the field of pipe bending and increasingly striving to satisfy the usefulness and/or necessity requirement of producing a bent pipe free from deformations, breaks, or cracks, which might even become apparent some time later, after the bent pipe has been produced and installed, also in the event the material, diameter, and thickness of the pipe are more sensitive to stretching stresses during the bending operation. In this regard, it is particularly worthy to point out the shape of the countermatrix groove which was described and claimed in U.S. Pat. No. 4,532,787 because a countermatrix of that shape is used in this invention embodiment as well, as will be better described later.

The co-pending U.S. Pat. application Ser. No. 07/363,406 filed June, 2, 1989, specified how the technique employed in prior art pipebending machines had been improved by two major innovations: the machines ability to operate at three different speeds; and the use of an auxiliary device which may either be separate and designed to be connected to the pipe-bending machine, or be built in the main body, and which consists of a special clutch having the function of engaging/disengaging the gear drive so as to either actuate the main matrix-carrying shaft for the pipe bending operation to be carried out, or automatically disengage the main matrix-carrying shaft.

As the importance of said two features was proved by practical experiments, they have been taken into consideration for more appropriate use in the pipe-bending machine this invention relates to, with the aim of designing a portable pipe-bending minimachine best suited to bend pipes in a little narrower range of diameters, namely 8 to 42 mm diameters, than the one the production has been devoted to so far, and which includes other features deserving particular attention, in addition to those just mentioned.

The improved features of the new pipe-bending machine according to this invention can be better interpreted by those skilled in the art if the following description of an embodiment of the machine is read attentively, making reference to the accompanying drawings in which:

FIG. 1 is a schematic top view of the boxlike main body of a pipe-bending machine according to this invention, wherein thicker and dashed lines represent the bending member or matrix in a position ready for the bending operation to be started, and the countermatrix to be put in the proper position for starting such operation;

FIG. 2 is a schematic top view of the special support on which is mounted the countermatrix suited to the pipe to be bent;

FIG. 3 is a schematic view of the right-hand side of the support shown in FIG. 2;

Figure 4:
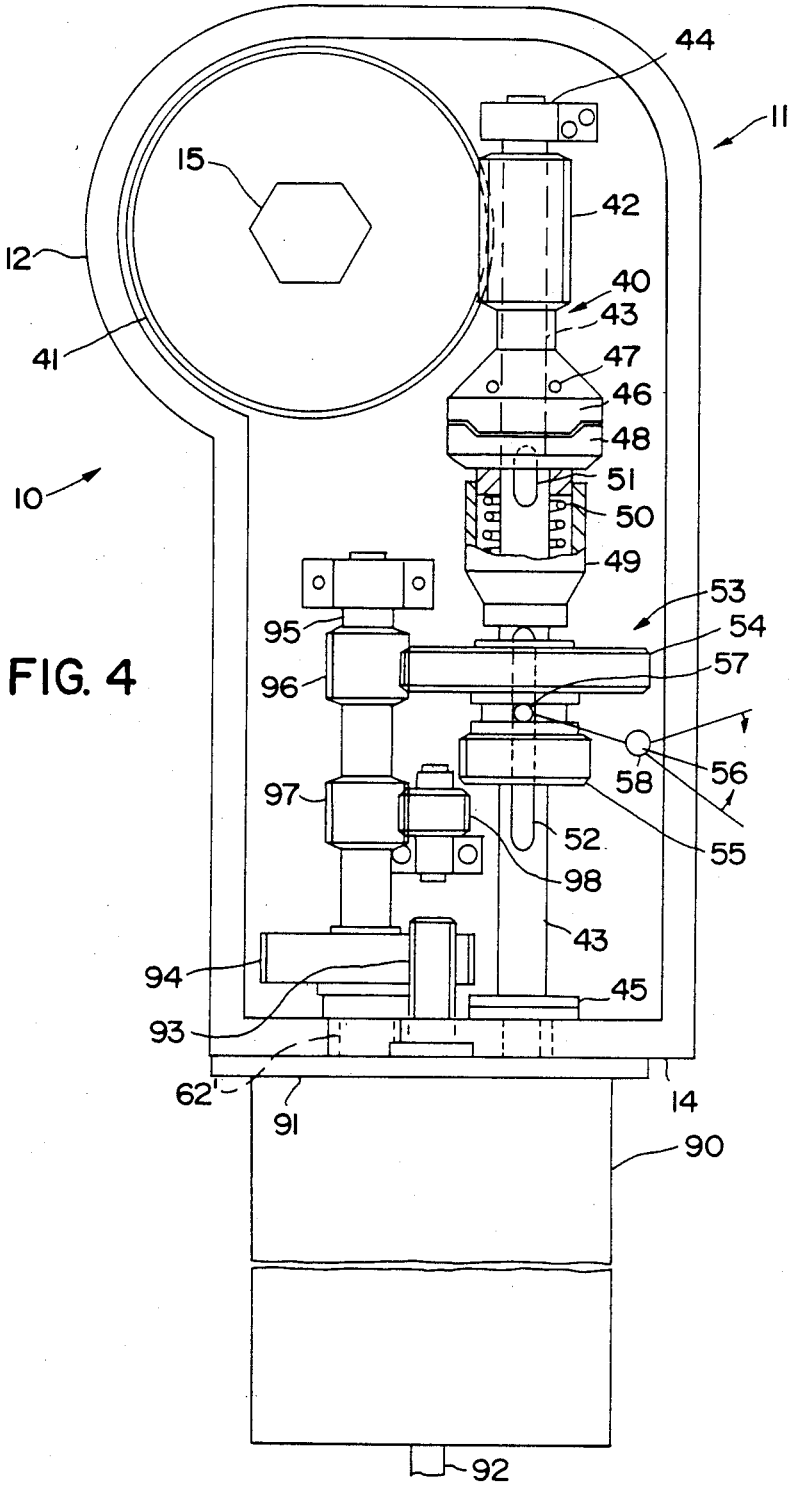
FIG. 4 is a schematic top view of the gear drive intended for use in this new type of machine, with the component members built in the lower part of the main body as may be viewed if the top part is removed; the figure includes also the motor and associated pinion gear controlling the gear drive, shown in the envisaged mounting position.

In spite of the small size and low weight from which the name "minimachine" has originated, the following innovative features of this invention deserve special attention, in connection with the corresponding illustration thereof in the drawings:

the main body;
the gear drive;
the matrix-countermatrix combination;
the gear drive motor control;
the gear drive manual control;

which will be described hereinafter as an example of embodiment.

MAIN BODY

Like certain other pipe-bending machines, the main body of this invention is an elongated carrying structure (11) of small size and relatively low weight as required to better meet the portability and operability requirements. According to this pipe-bending minimachine identified by number (10), the lower part (12) of main body (11) contains a gear drive (40) and its front wall

Figures 5, 6:
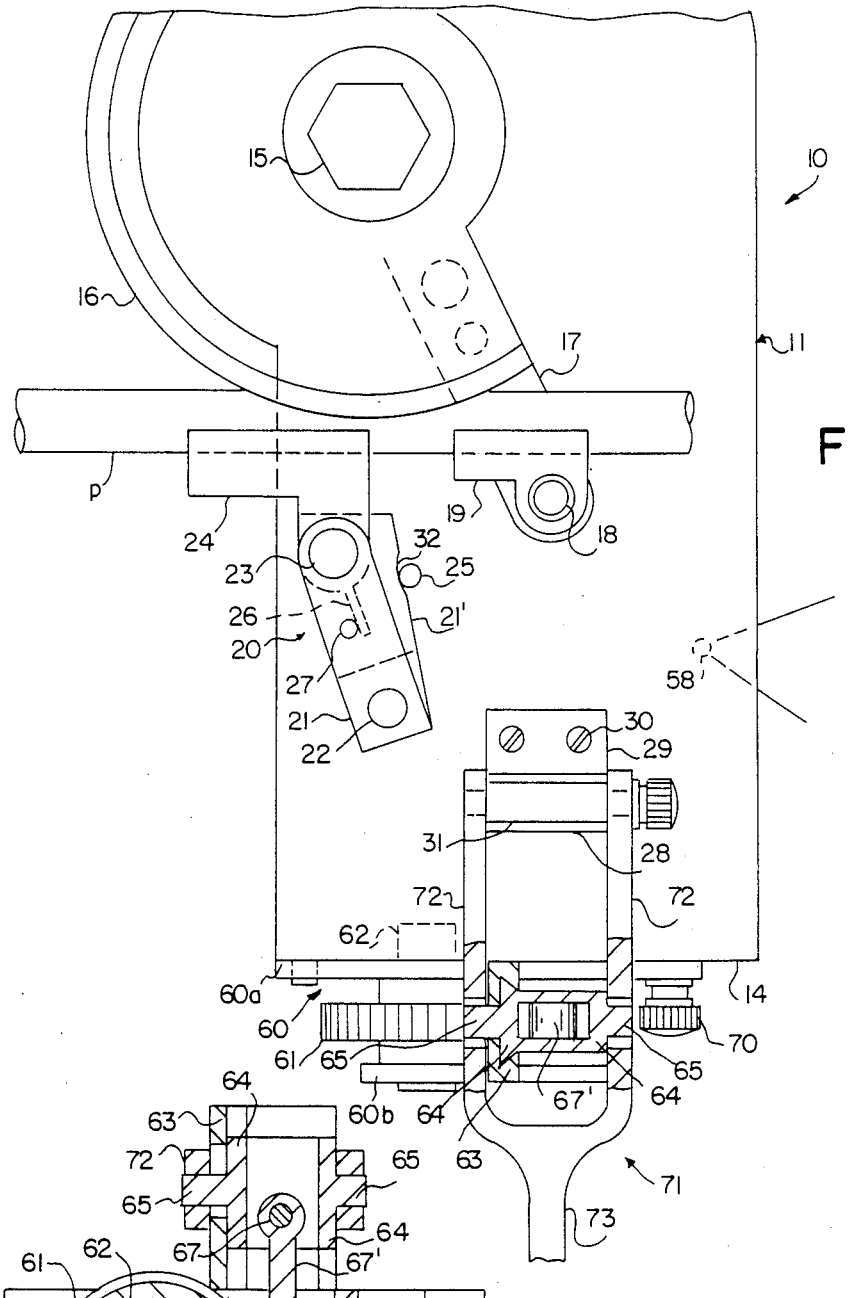
FIG. 5 is a schematic top view of the machine according to FIG. 1, with the pipe and the countermatrix shown in the position ready for the bending operation to be started and the manual control device mounted on one side of the main body.
FIG. 6 is a vertical sectional view taken on the mid plane of a ratchet wheel actuated by a lever and pawl to impart consecutive intermittent movements to the gear drive and corresponding angular movements to the matrix.

(14) is designed and preset to mount either a motor (90) integral with it, if the gear drive (40) is to be motor-driven, or a special support (60) for manual control, as will be better explained later. As shown in FIGS. 1 and 5, both the offset hexagonal head (15) of the main shaft on which the matrix (16) is to be mounted, and the pin (22) of countermatrix (24) special support (20), project from the top surface of main body (11). On said top surface is mounted a piece (28) with mounting plate (29), which is used as the horizontal axis fulcrum of a forklike lever (71) allowing manual control of gear drive (40).

GEAR DRIVE

The gear drive (40) substantially serves the following purposes:

(1) drive the main shaft carrying the matrix (16) at different speeds of rotation of the matrix either for pipe bending purposes, or for returning to the starting position, regardless of whether the machine operates under motor or manual control;

(2) automatically disengage the main matrix-carrying shaft when the amount of resisting torque resulting from the main shaft operation during the time a pipe is being bent, exceeds that of the driving torque applied to carry out the bending operation, and in that case the jaws of a clutch will be disengaged from each other, bearing in mind, however, that the amount of torque can be externally preset;

(3) facilitate the matrix-carrying shaft reverse rotation by the appropriate meshing of gear drive gear wheels, which can be easily accomplished by the operator;

(4) allow the operator to mount either the motor or the manual control device on the pipe-bending minimachine main body, in a relatively easy and handy manner;

(5) considering the peculiar features of the gear drive, as far as the main shaft rotation is concerned, it may be interesting to note that said shaft can be utilized, if required, in tool-carrying applications for such purposes as for instance;

screwing/unscrewing bolts, nuts, sleeves, pipes, etc.

threading or tapping;

pipe cutting and shearing, with the shaping to be adapted to appropriate coupling with the tool.

The following component parts of the gear drive (40) described herein are built in the lower part (12) of boxlike main body (11): a driving section comprising gear wheels mounted on a single longitudinal shaft (95), a driven section comprising gear wheels mounted on a second longitudinal shaft (43), parallel with shaft (95), which mounts also a coaxial auxiliary device including an engaging/disengaging clutch (48, 46). The jaw (48) rotates together with shaft (43), is able to slide because it is mounted on key (51), and is urged by a compression coil spring (50) to engage with jaw (46) whereas the jaw (46) can only rotate but not slide on the longitudinal shaft together with worm gear (42) integrally formed with it, because a guide ring, or the like (47) determines its position on shaft (43).

Shaft (43) carries a pair of coaxial, integrally mounted, reverse gear wheels (54, 55) which are locked to said shaft by means of long key (52), but can slide along shaft (43) under the control of a lever (only represented by longitudinal line (56)), pivoting on a fixed pin (58), and whose inner arm is provided, at one end, with a roller (57) for the controlled sliding of the reverse gear assembly along the shaft and hence the meshing with the other gear wheels used for reversing purposes. According to the embodiment shown in FIG. 4, and referring to the above description, shaft (95) carries a gear wheel (96) meshing with gear wheel (54) of reverse gear assembly (53), and a gear wheel (97) which is constantly in mesh with intermediate gear (98) which will mesh with gear wheel (55) of the reverse gear assembly when the operator moves lever (56) to slide the reverse gear assembly along shaft (43), thus throwing gear wheel (54) out of mesh with gear wheel (96).

The worm gear (42) meshes with helical gear wheel (41) to transmit rotary motion to the ma&n shaft whose offset hexagon head mounts, as previously mentioned, the matrix (16) to be controlled. It is obvious that control of the matrix is obtained when jaws (48, 46) are engaged with each other as shown in FIG. 4, because the worm gear (42) will then rotate together with shaft (43) which will, in turn, be driven by either one of gear wheels (96, 97) depending on the position to which either one of the mating gear wheels of reverse gear assembly (53) has been set.

It should be specified that both the motor and manual controls of the pipe-bending minimachine (10) according to the embodiment described herein, are obtained by rotating shaft (95) and hence gear wheels (94, 97, 96) mounted on it, as will be better explained later.

MATRIX-COUNTERMATRIX COMBINATION

The bending member or matrix (16) schematically shown in FIGS. 1 and 5 illustrating this example, is of a substantially conventional type, has a halfround groove to bend pipes up to 180°, and the centerlines of both its own groove and opposed groove (24') of countermatrix (24) preferably lie continuously in the same plane although both grooves will necessarily change in size depending on the diameter of the pipe to be bent.

The major innovative feature is the outer shape of countermatrix (24) and the special support (20) on which the latter is to be mounted.

It can be seen from FIGS. 1-3 that the support (20) substantially consists of a "C" piece whose flat parallel arms (21, 21') are an adequate distance apart, and extend from a solid piece provided with pin (22) whose axis is normal to the planes of said arms, and to be fastened to the top surface of boxlike main body (11) of minimachine (10). Pin (22) acts as a pivot for said support (20) so that the latter can freely rotate on it. The space between the inner parallel faces of arms (21, 21') houses the portion of the countermatrix projecting normal to groove (24') and having a hole for pin (23) which allows some angular movement of countermatrix (24), said angular movement being restricted by projection (26) diverging nearly radially from said projecting portion and restricting the free rotation of countermatrix on pivot (23) by striking against a pin (27) located between arms (21, 21') of support (20). According to FIGS. 1 and 5, the free rotation of countermatrix (24) support (20) is restricted too by a pin (25) projecting from the top surface of main body (11) to be struck by the lower arm (21') of the support.

The special features of both construction and operation of support (20) and associated countermatrix (24) will be further clarified here below to draw attention to the innovative features:

the support is constructed with predetermined shape and dimensions and allows any countermatrix (24) selected from an available set as suitable to bend a pipe of a given diameter, to be mounted on it and operate;

the distance x (FIGS. 2 and 3) from the centerline of groove (24') of countermatrix (24), to the countermatrix axis of rotation, changes according to the countermatrix selected for operation;

the ability of support (20) to turn on pivot (22) makes it easier to mount the countermatrix (24), as well as to make its groove (24') to initially rest against the tube p to be bent while the matrix is in the starting position for the subsequent bending operation;

during said initial stage, the edge of lower arm (21') of support (20) is in a position a short distance from the pin (25), and that distance will be reduced to zero when at the start of a bending operation, the matrix drags the countermatrix to the final position wherein the opposed grooves can interact in the most effective manner, which proves the usefulness and advantage of the special shape of the countermatrix groove to obtain the desired pipe bending.

GEAR DRIVE MOTOR CONTROL

In this embodiment of the invention, the motor (90) has been assumed to be fastened to wall (14) of the minimachine main body (11), through a supporting plate and pins and/or bolts driven in a direction parallel to the axes of shafts (43, 95) of the gear drive, as shown by dashed lines.

The motor may be of the same type as used on other pipe bending machines, such as the one, for instance, mentioned in the above-identified patent. It should be specified, as a particularly important feature of this invention, that in the pipe-bending minimachine (10) of this invention the motor carrying structure can be used also as a handle to be held and controlled by one hand, and that the motor shaft mounts a pinion gear (93) in mesh with gear wheel (94) which is one of those mounted on previously described shaft (95), the ratio between pinion (93) and gear wheel (94) being such as to provide a first speed reduction to which, according to the schematic view of FIG. 4, is added that provided by meshed gear wheels (96, 54), and the final one provided by the meshed worm gear (42) and helical gear (41), in order to obtain the desired rotation speed of matrix-carrying shaft (15).

Electric power is applied to the motor (90) through a cord (92).

A conventional switch, of for instance the toggle type (not shown), is a handy means allowing the operator to start the motor and manually control the machine (10) by one hand.

GEAR DRIVE MANUAL CONTROL

FIGS. 5 and 6 schematically show the main details of the component parts of a device (60) used to actuate the gear drive previously described with reference to FIG. 4.

As stated in the introduction, such a manual control device must be easy to mount on main body (11) of pipe bending minimachine (10) and must control the rotation of shaft (95) in such a way as to drive in either the forward or reverse direction the matrix (16), in a manner similar to that previously described concerning the motor control.

Figure 7:
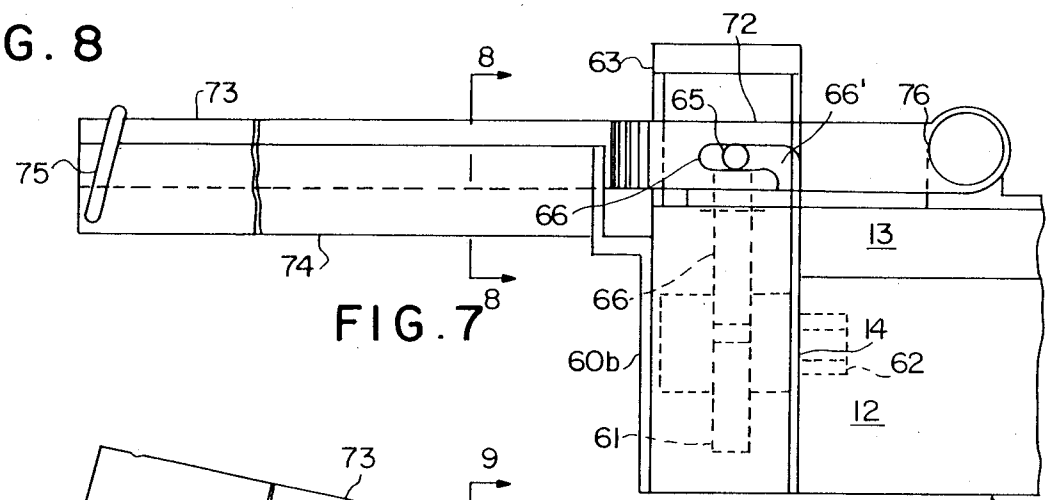
FIG. 7 is a schematic longitudinal elevation view of the manual control lever device, shown in the inoperative position.
Figure 9:
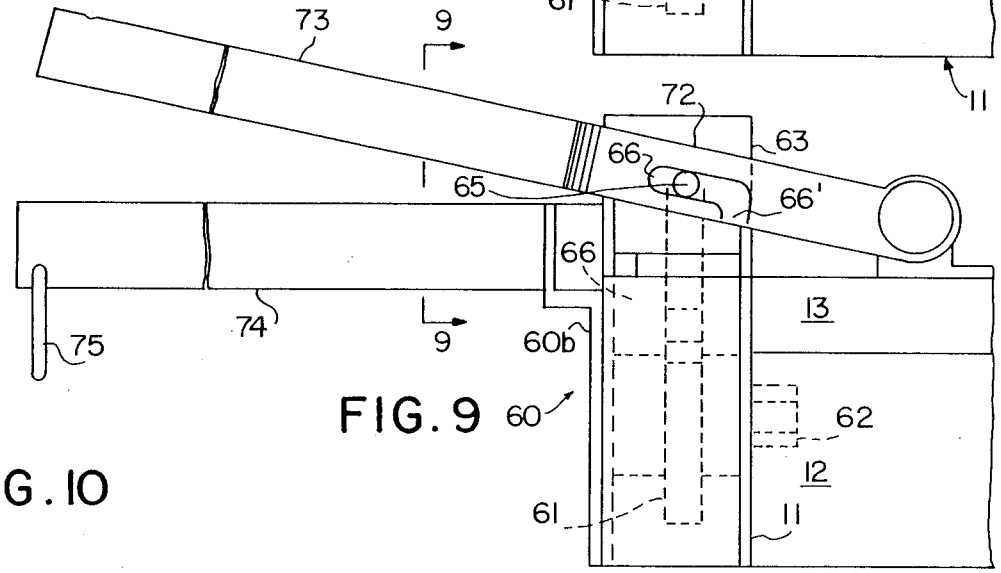
FIG. 9 is a schematic longitudinal elevation view of the manual control lever device, shown in the operative position.
Figure 8:
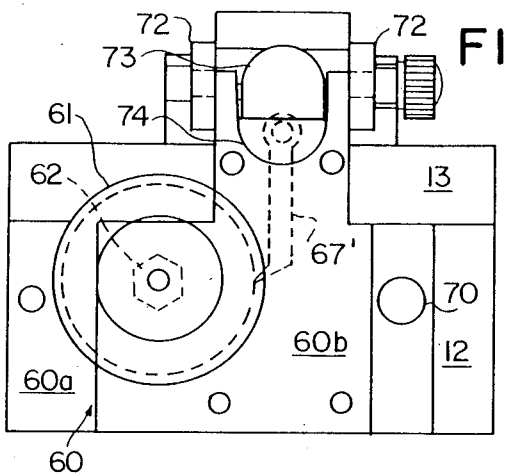
FIG. 8 is a sectional view taken on line 8—8 of FIG. 7.
Figure 10:
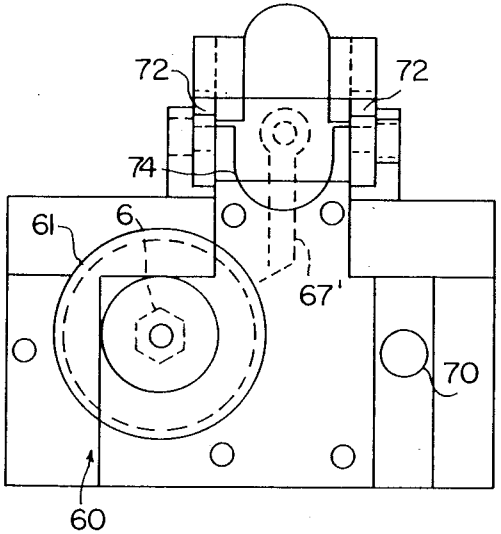
FIG. 10 is a sectional view taken on line 10—10 of FIG. 9.

The possible embodiment schematically shown in FIGS. 5 and 6, and with added details in FIGS. 7 and 8, makes use of a device (60) which can be fastened to the front wall (14) of main body (11) for instance by means of pin (68) and fixing screw (69), since it is shaped like a channel section consisting of two flat parallel surfaces (60*a*, 60*b*) formed into a single unit and separated by a spacer (60*c*) to provide room for a ratchet wheel (61) whose axis of rotation is normal to said surfaces. A "C" projection (63), integral with said channel section, has a dovetail bottom wall for a hollow piece (64), shaped to match the dovetail, to slide in the vertical direction, and whose recess houses a pawl (67') that engages the teeth of said ratchet wheel (61) to impart repeated consecutive intermittent angular movements to the ratchet wheel, and consequently to matrix (16) through said gear drive (40), the manual alternate movement of fork-like lever (71) being allowed by a conventional spring (not shown) located between the lever and the fixed part of the machine so as to make it still easier to operate the machine by one hand and in any position during the bending operation. When the machine is not in operation, the long arm (73) of lever (71) can be locked to the opposed guide-support (74) by means of for instance a ring hook (75).

We claim:

1. In a portable pipe-bending mini-machine comprising a box-like main body which incorporates a gear drive for either manual or motor control of a matrix-carrying shaft, the latter being provided with an auxiliary device that engages and disengages said shaft, and with gears that reverse the rotation of a matrix in both the manual and motor control modes, and in which an interchangeable countermatrix is mounted on a special revolving support, the countermatrix having a groove therein; the improvement which comprises:

a box-like main body (11) having a lower part (12) containing a gear drive (40) and having a front wall (14) adapted to mount either a motor (90) if the gear drive (40) is to be motor driven, or a support (60) for manual control;

said gear drive (40) comprising two longitudinal parallel shafts (95) and (43), a first one of which is used to accomplish motor control by means of said motor (90) and an associated pinion gear (93), and a second one to accomplish manual control by means of a lever (60), said motor (90) rotating said first shaft (95) along with gear wheels (94, 96, 97) mounted on it, of which one said gear wheel (94) can be driven by a pinion gear (93) of said motor (90) in the case of manual control, or by said first shaft (95) when it is coaxially coupled with a ratchet wheel (61) which is intermittently rotated by a pawl (66) engaging teeth of said ratchet wheel (61) under manual control of said lever (71); said shaft (43) being driven to rotate by said shaft (95) through either one of a pair of gear wheels (54, 55) integrated to form a reverse gear (53) mounted on sid second shaft (43) and locked to it by a key (52), one said gear wheel (54) meshing directly with a respective gear wheel (96) of said first shaft (95), whereas a gear wheel (55) of said reverse gear assembly meshes indirectly with a respective gear wheel (97) of said first shaft (95) through an intermediate gear (98) to reverse the rotation of said second shaft (43) and at the same time the direction of pipe travel, the latter shaft being provided with a worm gear (42) meshing with a respective helical gear (41) whose axis of rotation is the same as that of a main matrix-carrying shaft (16); said worm gear (42) forming a single unit with one jaw (46) of a clutch (46–48) which is held firmly in an engaged position by means of a compression coil spring (50), said jaw (46) of clutch (46–48) being maintained, together with said worm gear (42), in a predetermined position by means of a member (47), and being able to freely rotation on said second shaft (43) when it is disengaged from the other said jaw (48), the latter, on the contrary, causing the second shaft (43) to rotate with it as it is locked to the second shaft by means of key (51); said reverse gear (53) being able to slide along said second shaft (43) under the control of a longitudinal axis lever (56) pivoted on (58) and operated by means of end pins (57);

a matrix-countermatrix combination (16, 24) of which said matrix (16) has a half-round groove, and said countermatrix (24) has a confronting groove, a body of said countermatrix being located and revolving between flat parallel arms (21, 21') of a support (20) mounted and revolving on a pin (22) projecting from a top surface of said main body (11), said support (20) allowing the mounting of said interchangeable countermatrix (24) and the positioning of said confronting groove (24') at the start of a bending operation, angular movement of said countermatrix (24) being restricted by a projection thereof (26) striking against pin (27) of said support (20), while angular movement of the latter is restricted by a pin (25) similarly projecting from a top surface of said main body (11), and a manual control device assembly (60) for said mini-machine (10) comprising a channel section support fastened to said front wall (14) of said main body (11) through two flat parallel surfaces (**60*a*, 60*b*) and providing room for the mounting between said surfaces of said ratchet wheel (61) whose hub (62) is shaped to be inserted into a mating blind hole at an external end of said first shaft (95) of said gear drive (40), said channel section support being provided with a top projection (63) having a dovetail bottom wall in which slides a piece (64) in whose recess a pawl (67') is pivoted, and is provided with opposed projecting pins (65, 65) housed in slots (66, 66) of arms (72) of a fork-like lever (71), to allow said pawl (67') to engage teeth of said ratchet wheel (61) to impart consecutive intermittent angular movements to the ratchet wheel and consequently to matrix (16) through said gear drive (40**).

2. A portable pipe-bending machine according to claim 1, wherein said countermatrix (24) support (20) allows the countermatrix, with the pipe to be bent being held between said opposed grooves of the matrix and countermatrix, to be put in an initial position at the start of a bending operation, a position wherein an outer edge of a lower arm (21') of said support (20) is set slightly apart from said pin (25) limiting its angular movement, and then completes an angular movement of said support (20) after a bending operation has started, so that said matrix (16) will consequently draft said countermatrix (24) to permit the latter to exert the action of its said groove (24') on the pipe being bent.

3. A portable pipe-bending mini-machine according to claim 1, wherein the shape and dimensions of said countermatrix (24) support (20) allow the countermatrix to be interchangeable, a distance x from the centerline of its said groove (24') to the axis of said pin (23) on which the countermatrix is mounted being variable to suit the matrix (16)-countermatrix (24) combination selected according to the diameter of the pipe to be bent.

* * * * *